US012077407B2

(12) United States Patent
Kisselstein et al.

(10) Patent No.: US 12,077,407 B2
(45) Date of Patent: Sep. 3, 2024

(54) REUSABLE REEL

(71) Applicant: PPC BROADBAND, INC., East Syracuse, NY (US)

(72) Inventors: Jay A. Kisselstein, Mexico, NY (US); Richard Maroney, Camillus, NY (US); Noah P. Montena, Syracuse, NY (US); Brian K. Hanson, Cicero, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 17/491,337

(22) Filed: Sep. 30, 2021

(65) Prior Publication Data

US 2022/0098002 A1 Mar. 31, 2022

Related U.S. Application Data

(60) Provisional application No. 63/085,995, filed on Sep. 30, 2020.

(51) Int. Cl.
*B65H 75/14* (2006.01)
*B65H 75/22* (2006.01)

(52) U.S. Cl.
CPC ..... *B65H 75/14* (2013.01); *B65H 75/2245* (2021.05); *B65H 75/2254* (2021.05)

(58) Field of Classification Search
CPC ..... B65H 75/00; B65H 75/02; B65H 75/04; B65H 75/08; B65H 75/14; B65H 75/145;
(Continued)

(56) References Cited

U.S. PATENT DOCUMENTS 382,091 A * 5/1888 Kelsea ..... B65H 75/2272 242/609.1
2,194,795 A 3/1940 Johnson
(Continued)

FOREIGN PATENT DOCUMENTS

CA 2487703 A1 * 5/2006 ..... B65H 49/305
CN 108996326 A * 12/2018 ..... B65H 75/14
(Continued)

OTHER PUBLICATIONS

Search Report dated Jan. 13, 2022 in corresponding International Application No. PCT/US2021/053021, 5 pages.
(Continued)

*Primary Examiner* — Michael R Mansen
*Assistant Examiner* — Raveen J Dias
(74) *Attorney, Agent, or Firm* — MH2 TECHNOLOGY LAW GROUP LLP

(57) ABSTRACT

A reel includes a first reel member and a second reel member. The first reel member includes a first barrel portion, a first flange portion, and a first hub portion, and the second reel member includes a second barrel portion, a second flange portion, and a second hub portion. The first barrel portion and the second barrel portion are configured to be coupled with one another. The first barrel portion includes an inner wall and an outer wall that are spaced apart from one another in a radial direction of the first barrel portion, and the first barrel portion, the first flange portion, and the first hub portion are portions of a first single piece structure of unitary construction.

19 Claims, 3 Drawing Sheets

(58) Field of Classification Search
CPC ..... B65H 75/148; B65H 75/18; B65H 75/22; B65H 75/2218; B65H 75/2227; B65H 75/2254; B65H 75/2272; B65H 75/2281; B65H 75/229; B65H 75/241; B65H 75/38; B65H 2701/32; B65H 2701/33; B65H 2701/34; B65H 2701/35; B65H 2701/36; B65H 2701/534; H02G 11/02
See application file for complete search history.

(56) References Cited

U.S. PATENT DOCUMENTS 2,472,248 A * 6/1949 Cox ..... B65H 75/14 242/118.7
3,334,841 A * 8/1967 Burhop ..... G11B 23/037 242/118.61
3,743,208 A 7/1973 Schmitz
3,942,741 A * 3/1976 Hussar ..... B65H 75/2254 40/306
3,966,139 A * 6/1976 Terpak ..... B65H 75/14 242/118.62
4,667,896 A 5/1987 Frey et al.
4,726,534 A * 2/1988 Chenoweth ..... B65H 75/22 242/906
5,409,180 A * 4/1995 Stewing ..... B65H 75/14 242/614.1
5,464,171 A * 11/1995 Ripplinger ..... B29C 66/03 242/118.61
5,660,354 A * 8/1997 Ripplinger ..... B29C 66/14 242/118.61
5,908,172 A * 6/1999 Pierro ..... B65H 75/2227 242/609.1
5,971,317 A * 10/1999 Jaros ..... B65H 75/14 242/607
6,036,138 A * 3/2000 Sexton ..... B29C 66/5344 242/608.8
6,102,327 A * 8/2000 Ripplinger ..... B29C 66/1222 242/118.61
6,343,765 B1 * 2/2002 Wen ..... B65H 75/2227 242/609.3
6,425,550 B1 * 7/2002 Gayowski ..... G11B 23/037 242/608.5
6,481,904 B2 11/2002 Fukugawa et al.
6,676,069 B1 * 1/2004 Davis ..... B65H 75/2416 242/608.5
6,736,349 B1 * 5/2004 Boisdon ..... B65H 75/22 242/118.61
6,802,420 B2 10/2004 Fukugawa et al.
6,857,586 B2 2/2005 Kadota et al.
6,883,744 B2 * 4/2005 Couchey ..... B65H 75/148 242/475.7
7,237,746 B2 * 7/2007 Couchey ..... B65H 75/148 242/603
8,074,916 B2 * 12/2011 Penumatcha ..... G02B 6/4457 242/604
8,235,323 B2 * 8/2012 Newton, Jr. ..... B65H 75/28 242/125.3
8,480,023 B2 * 7/2013 Penumatcha ..... B65H 75/14 242/604
9,695,008 B2 * 7/2017 Thakare ..... B65H 49/305
10,584,012 B2 * 3/2020 Nilsson ..... B65H 75/14
10,941,015 B1 * 3/2021 Matari ..... B65H 75/2236
11,084,685 B2 * 8/2021 Matari ..... B65H 75/2236
11,560,287 B2 * 1/2023 Matari ..... B65H 49/24
2003/0146333 A1 * 8/2003 Couchey ..... B65H 75/2227 242/476.1
2005/0139723 A1 * 6/2005 Couchey ..... B65H 75/2227 242/609.1
2007/0252027 A1 * 11/2007 Tsutsui ..... G11B 23/037 242/613
2009/0084887 A1 * 4/2009 Aiston ..... B65H 75/22 29/428
2009/0090806 A1 * 4/2009 Chen ..... B65H 75/22 242/401
2009/0230228 A1 * 9/2009 Penumatcha ..... B65H 75/14 242/603
2011/0259992 A1 * 10/2011 Newton, Jr. ..... B65H 75/14 242/407
2012/0145821 A1 * 6/2012 Penumatcha ..... B65H 75/146 242/604
2013/0075522 A1 * 3/2013 Penumatcha ..... B65H 75/14 242/614
2014/0001305 A1 * 1/2014 Penumatcha ..... B65H 75/146 242/604
2014/0312159 A1 * 10/2014 Troitzsch ..... B65H 75/2281 242/608.2
2017/0227729 A1 * 8/2017 Marcouiller ..... B65H 75/14
2019/0137718 A1 * 5/2019 Marcouiller ..... B65H 75/26
2019/0218056 A1 * 7/2019 Chen ..... B33Y 40/00
2019/0276266 A1 * 9/2019 Nilsson ..... B65H 75/2227
2021/0206596 A1 * 7/2021 Matari ..... B65H 75/2263
2021/0362976 A1 * 11/2021 Matari ..... B65H 49/24
2022/0041401 A1 * 2/2022 Packer ..... B65H 75/2272
2022/0305308 A1 * 9/2022 Kroh ..... B65H 75/48

FOREIGN PATENT DOCUMENTS

DE 19700185 A1 * 7/1998 ..... B65H 75/22
DE 202008005926 U1 7/2008
FR 2848198 A1 6/2004
GB 1417961 A 12/1975
GB 2448661 A * 10/2008 ..... B65H 75/14
WO 2007093781 A1 8/2007

OTHER PUBLICATIONS

Written Opinion dated Jan. 13, 2022 in corresponding International Application No. PCT/US2021/053021, 5 pages.

* cited by examiner

REUSABLE REEL

CROSS-REFERENCE TO RELATED APPLICATION

This application claims the benefit of U.S. Provisional Application No. 63/085,995, filed on Sep. 30, 2020. The disclosure of the prior application is hereby incorporated by reference herein in its entirety.

TECHNICAL FIELD

The present disclosure relates to a reusable reel and, more particularly, to a reusable reel for storing and dispensing cable, wire, and the like.

BACKGROUND

Conventionally, various types of cable, wire, and the like are wound onto reels for storage, shipping, and field use. Typical reels are constructed of wood or plastic that can withstand the stresses of storage and shipping. The weight of the reels adds to the cost of transportation of the cable, wire, or the like that is held on the reel, which increases the cost that must be paid for by the customer or vendor. After the reels are emptied, typically, the reels are then thrown away because the cost of returning them to the supplier for reuse is too high.

Therefore, it may be desirable to provide a reel that is reusable. For example, it may be desirable to provide a reel that can be assembled and disassembled by a technician such that a bundle of cable, wire, or the like can be mounted on the reel in the field. In some aspects, it may be desirable to provide a reel that is configured to receive a reel-less bundle of cable, wire, or the like.

SUMMARY

According to an exemplary embodiment of the disclosure, a reusable reel includes a first reel member and a second reel member. The first reel member includes a first barrel portion, a first flange portion, and a first hub portion, and the second reel member includes a second barrel portion, a second flange portion, and a second hub portion. The first barrel portion and the second barrel portion are configured to be coupled with one another. The first barrel portion includes an inner wall and an outer wall that are spaced apart from one another in a radial direction of the first barrel portion, and the second barrel portion includes an inner wall and an outer wall that are spaced apart from one another in a radial direction of the second barrel portion. The coupled first barrel portion and second barrel portion are configured to have a reel-less bundle of cable mounted thereon between the first flange portion and the second flange portion. The first barrel portion, the first flange portion, and the first hub portion are portions of a first single piece structure of unitary construction, and the second barrel portion, the second flange portion, and the second hub portion are portions of a second single piece structure of unitary construction. The inner wall and the outer wall of the first barrel portion and a wall of the first hub portion have a uniform thickness, and the inner wall and the outer wall of the second barrel portion and a wall of the second hub portion have a uniform thickness. The inner wall and the outer wall of the first barrel portion are configured to move toward one another in the radial direction and/or the inner wall and the outer wall of the second barrel portion are configured to move toward one another when a force is applied to the reel in the radial direction.

In some aspects, the first hub portion and the second hub portion are configured to be aligned with one another in a first direction when the first barrel portion is coupled with the second barrel portion.

According to various aspects, the first reel member and the second reel member are configured to rotate together when cable is being paid out from a reel-less bundle of cable mounted on the coupled first barrel portion and second barrel portion.

In various aspects, an inner wall of the first barrel portion includes a plurality of axially extending ribs that project radially inward from the inner wall, an outer wall of the second barrel portion includes a plurality of axially extending grooves configured to receive the plurality of axially extending ribs, and wherein the plurality of axially extending ribs and the plurality of axially extending grooves are configured to couple the first barrel portion and the second barrel portion to rotate together.

According to an exemplary embodiment of the disclosure, a reel includes a first reel member and a second reel member. The first reel member includes a first barrel portion, a first flange portion, and a first hub portion, and the second reel member includes a second barrel portion, a second flange portion, and a second hub portion. The first barrel portion and the second barrel portion are configured to be coupled with one another. The first barrel portion includes an inner wall and an outer wall that are spaced apart from one another in a radial direction of the first barrel portion, and the second barrel portion includes an inner wall and an outer wall that are spaced apart from one another in a radial direction of the second barrel portion. The first barrel portion, the first flange portion, and the first hub portion are portions of a first single piece structure of unitary construction, and the second barrel portion, the second flange portion, and the second hub portion are portions of a second single piece structure of unitary construction.

In some aspects, the inner wall and the outer wall of the first barrel portion and a wall of the first hub portion have a uniform thickness, and the inner wall and the outer wall of the second barrel portion and a wall of the second hub portion have a uniform thickness.

According to various aspects, the first hub portion and the second hub portion are configured to be aligned with one another in a first direction when the first barrel portion is coupled with the second barrel portion.

In various aspects, the inner wall and the outer wall of the first barrel portion are configured to move toward one another and/or the inner wall and the outer wall of the second barrel portion are configured to move toward one another to absorb a force applied to the reel in the radial direction.

According to some aspects, the first reel member and the second reel member are configured to rotate together when cable is being paid out from a reel-less bundle of cable mounted on the coupled first barrel portion and second barrel portion.

In some aspects, an inner wall of the first barrel portion includes a plurality of axially extending ribs that project radially inward from the inner wall, an outer wall of the second barrel portion includes a plurality of axially extending grooves configured to receive the plurality of axially extending ribs, and the plurality of axially extending ribs and the plurality of axially extending grooves are configured to couple the first barrel portion and the second barrel portion to rotate together.

According to various aspects, the first and second barrel portions are configured to have a reel-less bundle of cable mounted thereon between the first flange portion and the second flange portion when coupled together.

According to an exemplary embodiment of the disclosure, a reel includes a first reel member and a second reel member. The first reel member includes a first barrel portion, a first flange portion, and a first hub portion, and the second reel member includes a second barrel portion, a second flange portion, and a second hub portion. The first barrel portion and the second barrel portion are configured to be coupled with one another. The first barrel portion includes an inner wall and an outer wall that are spaced apart from one another in a radial direction of the first barrel portion, and the first barrel portion, the first flange portion, and the first hub portion are portions of a first single piece structure of unitary construction.

In some aspects, the inner wall and the outer wall of the first barrel portion and a wall of the first hub portion have a uniform thickness.

According to various aspects, the second barrel portion includes an inner wall and an outer wall that are spaced apart from one another in a radial direction of the second barrel portion. In some aspects, the inner wall and the outer wall of the first barrel portion are configured to move toward one another and/or the inner wall and the outer wall of the second barrel portion are configured to move toward one another when a force is applied to the reel in the radial direction. In various aspects, the inner wall and the outer wall of the second barrel portion and a wall of the second hub portion have a uniform thickness.

According to some aspects, the first hub portion and the second hub portion are configured to be aligned with one another when the first barrel portion is coupled with the second barrel portion.

In various aspects, the inner wall and the outer wall of the first barrel portion are configured to move toward one another when a force is applied to the reel in the radial direction.

According to various aspects, the first reel member and the second reel member are configured to rotate together when cable is being paid out from a reel-less bundle of cable mounted on the coupled first barrel portion and second barrel portion.

In some aspects, an inner wall of the first barrel portion includes a plurality of axially extending ribs that project radially inward from the inner wall, an outer wall of the second barrel portion includes a plurality of axially extending grooves configured to receive the plurality of axially extending ribs, and the plurality of axially extending ribs and the plurality of axially extending grooves are configured to couple the first barrel portion and the second barrel portion to rotate together.

The foregoing and other features of construction and operation of the invention will be more readily understood and fully appreciated from the following detailed disclosure, taken in conjunction with accompanying drawings.

DETAILED DESCRIPTION OF EMBODIMENTS

As a preface to the detailed description, it should be noted that, as used in this specification and the appended claims, the singular forms "a," "an," and "the" include plural referents, unless the context clearly dictates otherwise.

Figure 1:
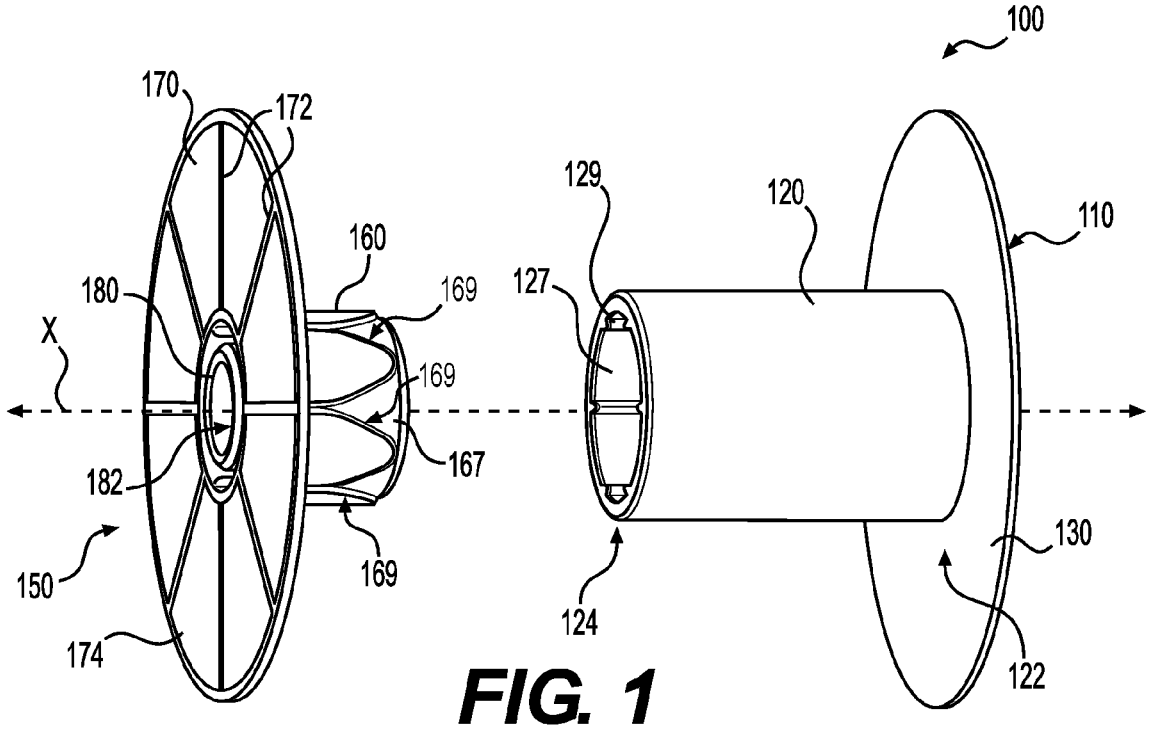
FIG. 1 is a perspective view of an exemplary reusable reel in accordance with various aspects of the disclosure.
Figure 2:
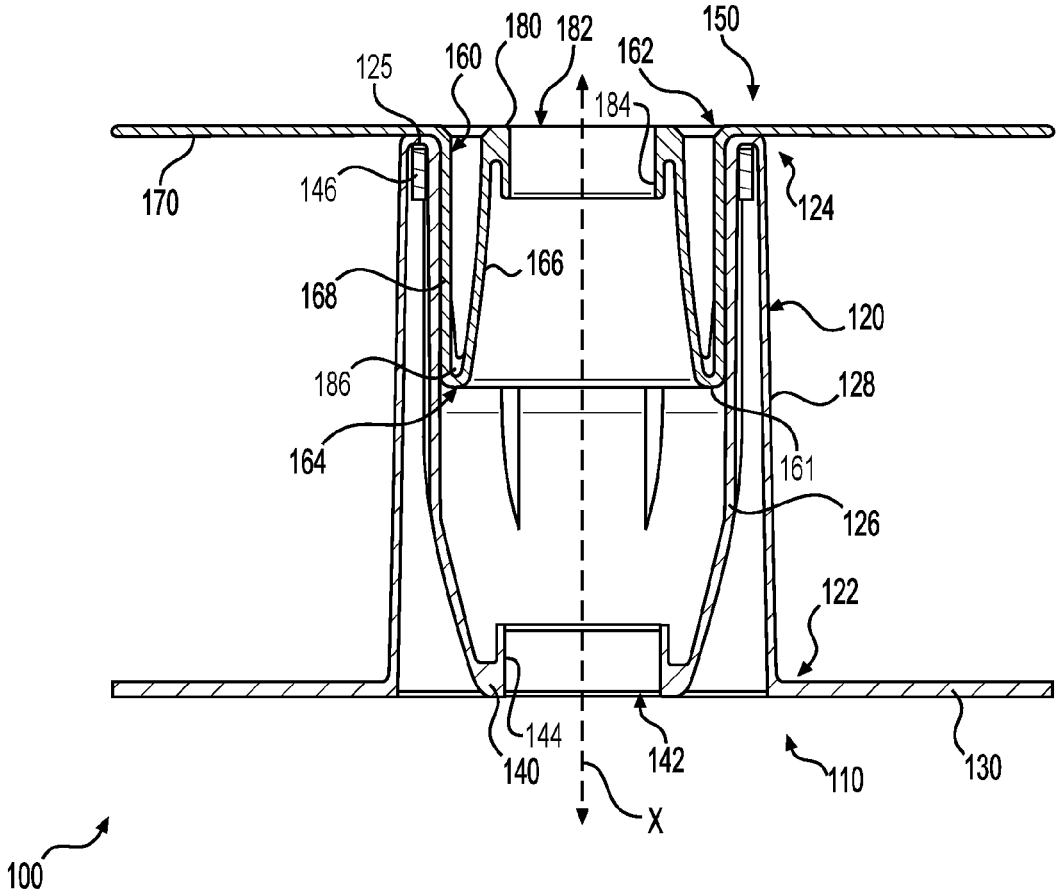
FIG. 2 a side cross-sectional view of the reusable reel of FIG. 1.
Figures 3, 4:
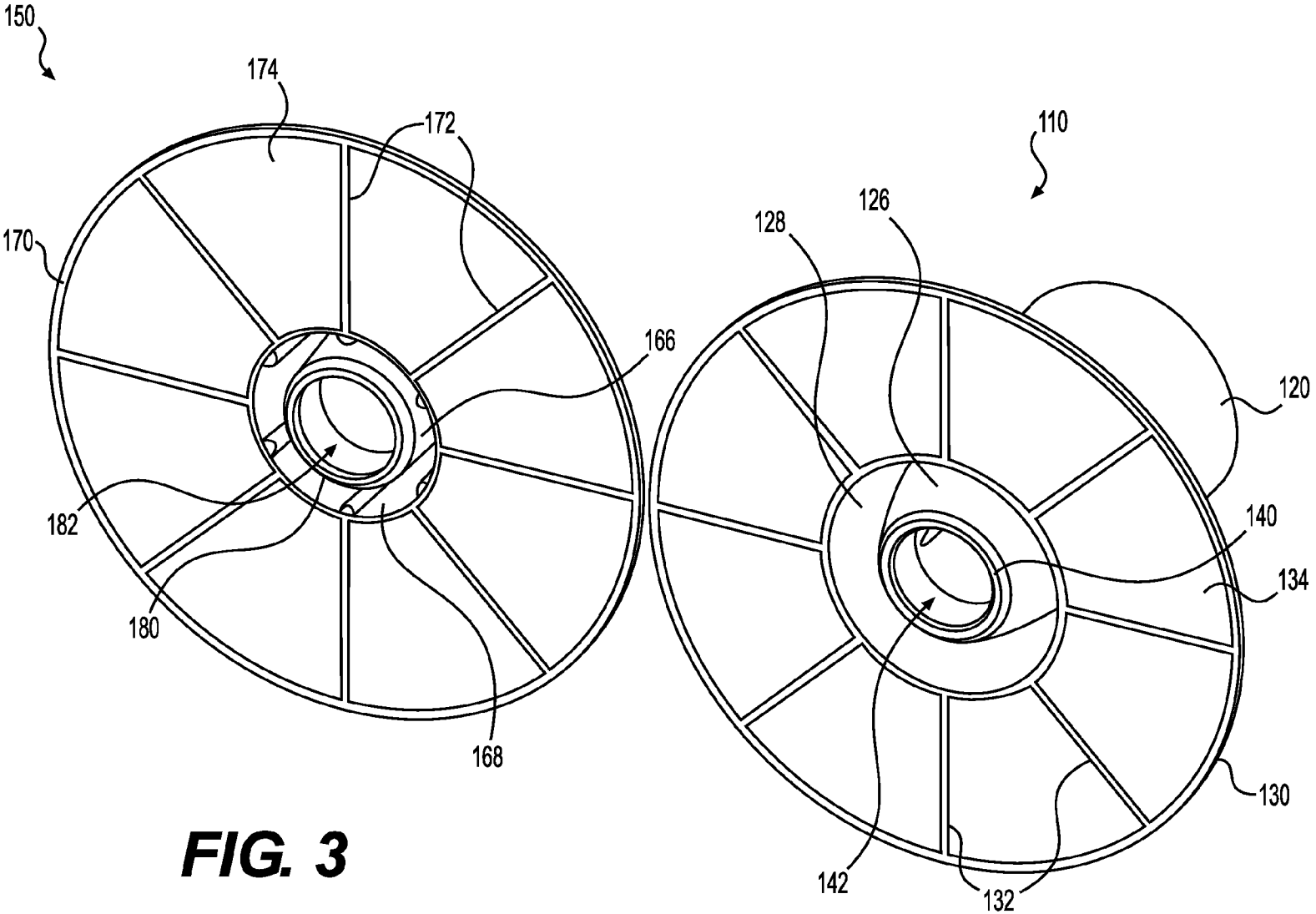
FIG. 3 is a first side perspective view of a first reel member of the reusable reel of FIG. 1.
FIG. 4 is a first side perspective view of a second reel member of the reusable reel of FIG. 1.
Figure 5:
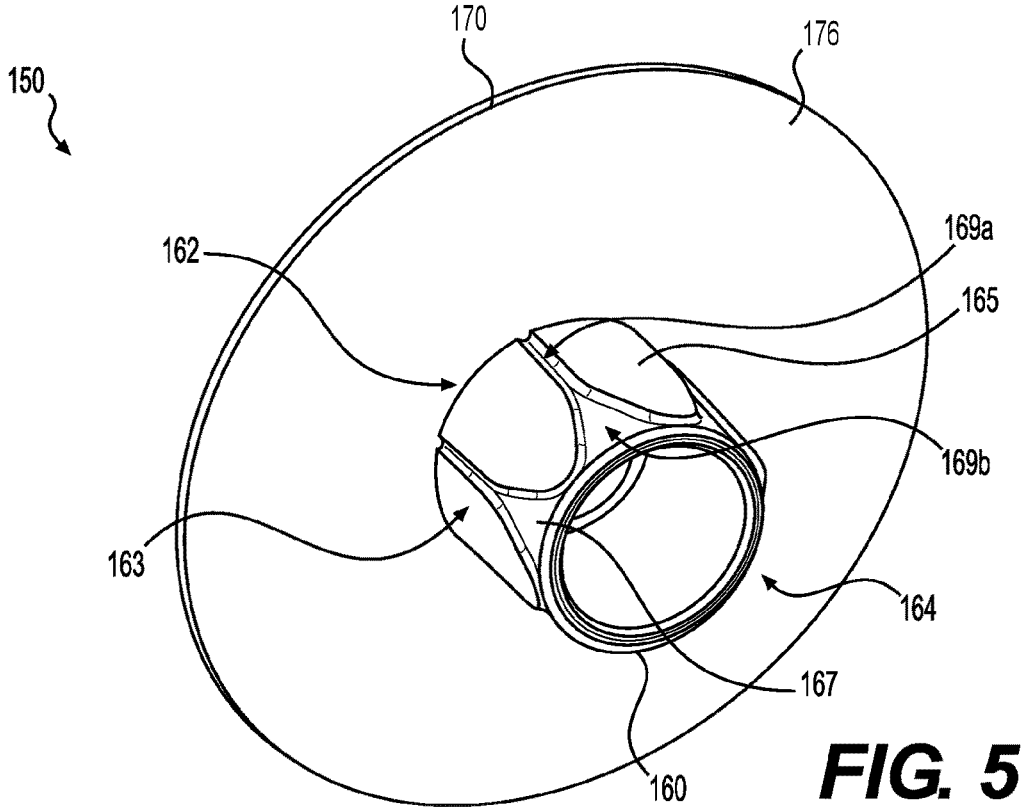
FIG. 5 is a second side perspective view of the second reel member of FIG. 4.
Figure 6:
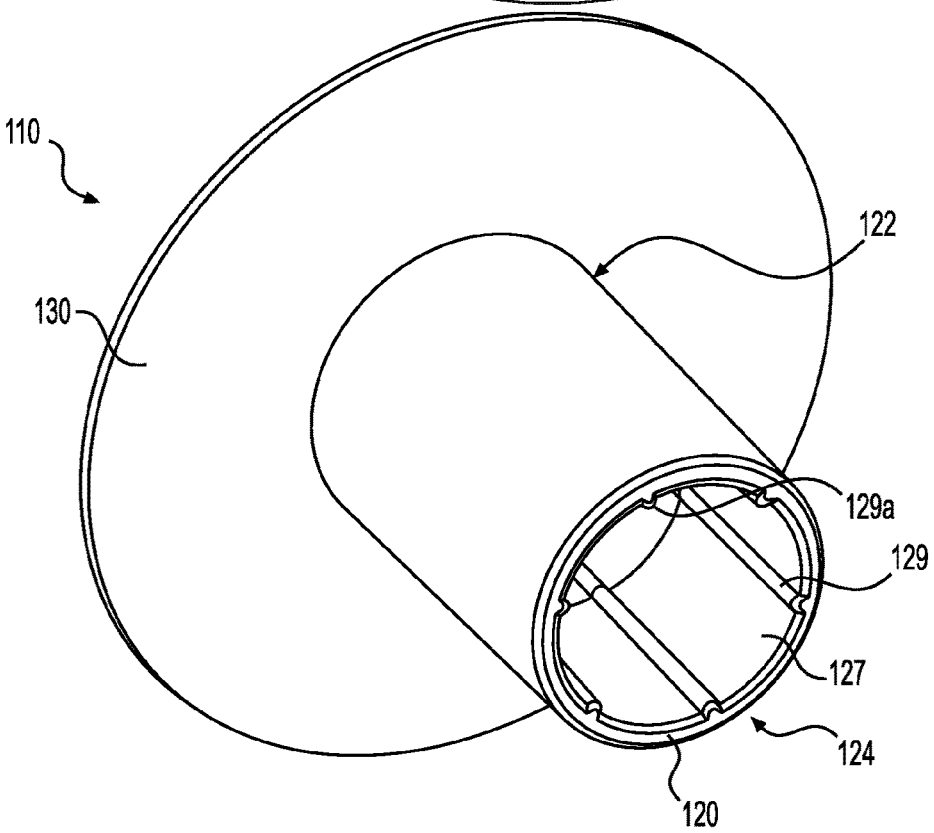
FIG. 6 is a second side cross-sectional view of the first reel member of FIG. 3.

Referring to FIGS. 1 and 2, an exemplary reusable reel 100 in accordance with various aspects of the disclosure is illustrated and described. The reusable reel 100 includes a first reel member 110 and a second reel member 150 that are configured to be coupled with one another, as described in more detail below.

The first reel member 110 includes a barrel portion 120, a flange portion 130, and a hub portion 140. The flange portion 130 extends from a first end 122 of the barrel portion 120 in a plane that is perpendicular to a longitudinal axis X of the barrel portion 120. As illustrated in FIG. 2, the barrel portion 120 includes an inner wall 126 and an outer wall 128 that are spaced apart from one another in a radial direction of the barrel portion 120. The outer wall 128 of the barrel portion 120 extends from the flange portion 130 at the first end 122 of the barrel portion 120 to a second end 124 of the barrel portion 120. The inner wall 126 extends from the hub portion 140 at the first end 122 of the barrel portion 120 to the second end 124 of the barrel portion 120. The inner wall 126 and the outer wall 128 are connected to one another at the second end 124 of the barrel portion 120, for example, by a radial wall 125. In some aspects, the inner wall 126 and the outer wall 128 may be connected directly to one another without the radial wall 125 or may be connected to one another by a curved wall.

The barrel portion 120, the flange portion 130, and the hub portion 140 are portions of a single piece (i.e., monolithic) structure of unitary construction. The flange portion 130 and the inner wall 126 and outer wall 128 of the barrel portion 120 may have a uniform wall thickness that simplifies the molding process by not requiring slides. The flange portion 130 may include radially extending ribs 132 along an outer surface 134 of the flange portion 130 that add strength and durability to the flange portion 130. The barrel portion 120 may include webbing or other strengthening structure 146 between the inner wall 126 and the outer wall 128 at the second end 124.

The hub portion 140 includes a hub wall 144 and a center opening 142 that is configured to be mounted on a support hub (not shown) of a frame (not shown) such that the hub portion 140 can rotate relative to the support hub and frame. The hub wall 144 extends from the inner wall 126 at the first end 122 in a direction toward the second end 124. The hub wall 144 may have a wall thickness that is the same as the wall thickness of the flange portion 130, the inner wall 126, and/or the outer wall 128.

The second reel member 150 includes a barrel portion 160, a flange portion 170, and a hub portion 180. The flange portion 170 extends from a first end 162 of the barrel portion 160 in a plane that is perpendicular to a longitudinal axis X of the barrel portion 160. As illustrated in FIG. 2, the barrel portion 160 includes an inner wall 166 and an outer wall 168 that are spaced apart from one another in a radial direction of the barrel portion 160. The outer wall 168 of the barrel portion 160 extends from the flange portion 170 at the first end 162 of the barrel portion 160 to a second end 164 of the barrel portion 160. The inner wall 166 extends from the hub portion 180 at the first end 162 of the barrel portion 160 to the second end 164 of the barrel portion 160. The inner wall 166 and the outer wall 168 are connected to one another at the second end 164 of the barrel portion 160, for example, by a curved wall 161. In some aspects, the inner wall 166 and the outer wall 168 may be connected directly to one another without the curved wall 161 or may be connected to one another by a radial wall.

The barrel portion 160, the flange portion 170, and the hub portion 180 are portions of a single piece (i.e., monolithic) structure of unitary construction. The flange portion 170 and the inner wall 166 and outer wall 168 of the barrel portion 120 may have a uniform wall thickness that simplifies the molding process by not requiring slides. The flange portion 170 may include radially extending ribs 172 along an outer surface 174 of the flange portion 170 that add strength and durability to the flange portion 170. The barrel portion 160 may include webbing or other strengthening structure 186 between the inner wall 166 and the outer wall 168 at the second end 164.

The hub portion 180 includes a hub wall 184 and a center opening 182 that is configured to be mounted on a support hub (not shown) of a frame (not shown) such that the hub portion 180 can rotate relative to the support hub and frame. The hub wall 184 extends from the inner wall 166 at the first end 162 in a direction toward the second end 164. The hub wall 184 may have a wall thickness that is the same as the wall thickness of the flange portion 170, the inner wall 166, and/or the outer wall 168.

When the barrel portion 120 and the barrel portion 160 are coupled to one another, the center opening 182 may be configured to be aligned with the center opening 142 of the hub portion 150 of the first reel member 110, and the center openings 142, 182 may be configured to receive a single hub or separate hub portions.

The barrel portions 120, 160 are configured such that if a force is applied to the reel 100 in a direction perpendicular or transverse to the X axis (i.e., the radial direction), the inner wall 126 and outer wall 128 of the barrel portion 120 can move toward one another and/or the inner wall 166 and the outer wall 168 of the barrel portion 160 can move toward one another to absorb the force and prevent breakage of the flanges 130, 170 and the hub portions 140, 180. For example, if a technician drops the reel 100 such that a force is applied to the reel in a direction perpendicular or transverse to the X axis (i.e., the radial direction), the inner wall 126 and outer wall 128 of the barrel portion 120 are configured to move toward one another and/or the inner wall 166 and the outer wall 168 of the barrel portion 160 are configured to move toward one another to absorb the force. That is, the inner wall 126 and outer wall 128 of the barrel portion 120 and the inner wall 166 and the outer wall 168 of the barrel portion 160 are compliant (e.g., resilient) to provide a degree of radial compliance when a radial force is applied to the reel 100.

The inner wall 126 of the barrel portion 120 of the first reel member 110 has an inner surface 127 with a plurality of angularly spaced ridges 129 that extend axially from the second end 124 of the barrel portion 120 toward the flange portion 130 at the first end 122 of the barrel portion 120 in a direction parallel to the longitudinal axis X. As illustrated, the inner surface 127 includes six ridges 129, but in some embodiments, the inner surface 127 may include less than or more than six ridges. As illustrated, the six ridges 129 are equally spaced about the periphery of the inner wall 126, but in some aspects, the ridges may be spaced unequally about the periphery to insure a desired alignment between the first reel member 120 and the second reel member 150, as discussed below.

The outer wall 168 of the barrel portion 160 of the second reel member 150 has an outer surface 167 with a plurality of grooves 169 that extend axially from the second end 164 of the barrel portion 160 toward the flange portion 170 at the first end 162 of the barrel portion 160 in a direction parallel to the longitudinal axis X. As illustrated, the outer surface 167 includes six grooves 169, but in some embodiments, the outer surface 167 may include less than or more than six grooves. As illustrated, the six grooves 169 are equally spaced about the periphery of the outer wall 168. The grooves 169 are spaced apart from one another about the periphery of the outer wall 168 by guide portions 165. The guide portions 165 have an arc size that tapers from a middle 163 of the barrel portion 160 toward the second end 164 of the barrel portion 160 in a direction parallel to the longitudinal axis X. As result, a circumferential dimension of the grooves 169 increases from a narrower groove portion **169*a* that extends from the first end 162 to the middle 163 to an expanding groove portion 169*b* that extends from the middle 163 toward the second end 164. The guide portions 165 may have a rounded end at the second end of the barrel portion 160 such that the guide portions 165 are configured to guide the ridges 129 into the grooves 169 when the first reel member 110 and the second reel member 150 are being coupled together. It should be appreciated that the guide portions 165 may have any other desired shape that facilitates coupling of the first reel member 110 and the second reel member 150**.

The inside diameter of the inner wall 126 of the barrel portion 120 of the first reel member 150 is greater than an outside diameter of the outer wall 168 of the barrel portion 160 of the second reel member 150. The innermost edges **129*a* of the ridges 129 extending radially inward from the inner surface 127 of the barrel portion 120 define an inside diameter that is less than the outside diameter of the outer wall 168 of the barrel portion 160 of the second reel member 150. The grooves 169 have a radial depth sized to receive the ridges 129 without an interference fit to allow for easy assembly and disassembly. It should be appreciated that, in some embodiments, the grooves 169 may have a radial depth sized to receive the ridges 129** in an interference or friction fit.

The barrel portion 160 of the second reel member 150 may have a length in the direction of longitudinal axis X that is smaller than a length of the barrel portion 120 of the first reel member 110. In such an embodiment, when the barrel portion 160 of the second reel member 150 is inserted into the barrel portion 120 of the first reel member 110, the second end 124 of the barrel portion 120 contacts an inner surface 176 of the flange portion 170 of the second reel member 150 to create a hard stop that signals to a technician that the first reel member 110 and the second reel member 150 are fully coupled together. Also, in such an embodiment, the ridges 129 do not need to extend the entire length from the second end 124 of the barrel portion 120 to the flange portion 130. When the ridges 129 are received in the grooves 169, the first reel member 110 and the second reel member 150 are configured to rotate together with one another to facilitate payout of cable or wire from the reusable reel 100. In some aspects, the ridges 129 and grooves 169 may be eliminated, and the first reel member 110 and the second reel member 150 may therefore rotate independently of one another.

The larger circumferential dimension of the grooves 169 at the second end 164 of the barrel portion 120 makes it easier for a technician to insert the second reel member 150 into the first reel member 110. For example, a technician does not need to line up similarly sized grooves and ridges when coupling the first reel member 110 and the second reel member 150. Instead, regardless of whether the technician lines up the ridges 129 of the first reel member 110 with the narrower portions 169*a* of the grooves 169 of the second reel member 150, the guide portions 165 will guide the ridges 129 toward the narrower portions 169*a* of the grooves 169.

In some aspects, the grooves may be spaced unequally about the periphery to insure a desired alignment between the first reel member 120 and the second reel member 150. For example, the unequally spaced ridges and the unequally spaced grooves may be spaced the same about the periphery so that the first reel member 120 and the second reel member 150 are keyed to a particular orientation relative to one another.

In use, a technician places a separately packaged bundle of cable (not shown) on the barrel portion 120 of the first reel member 110. The bundle is not required to have a reel since the bundle will be placed on the reusable reel 100. The barrel portion 160 of the second reel member 150 is inserted into the barrel portion 120 of the first reel member. As discussed above, the technician does not need to align the grooves 169 of the second reel member 150 with the ridges 129 of the first reel member 110 because the guide portions 165 self-align the grooves 169 and ridges 129. The barrel portion 160 second reel member 150 is inserted into the barrel portion 120 of the first reel member 110 until the barrel portion 120 engages the inner surface 176 of the flange portion 170 of the second reel member 150. A first one of the hub portions 140, 180 can then be placed on a support hub of a frame. In some applications, the support hub and frame may be inside of a carrying bag or case. The second of the hub portions 140, 180 can then be placed on the support hub or a separate support hub of a separate frame. The reusable reel 100 can then be rotated relative to the support hub and frame to pay out cable or wire.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A reusable reel, comprising:

a first reel member including a first barrel portion, a first flange portion, and a first hub portion; and a second reel member including a second barrel portion, a second flange portion, and a second hub portion;

wherein the first barrel portion and the second barrel portion are configured to be coupled with one another;

wherein the first barrel portion includes an inner wall and an outer wall that are spaced apart from one another in a radial direction of the first barrel portion;

wherein the second barrel portion includes an inner wall and an outer wall that are spaced apart from one another in a radial direction of the second barrel portion;

wherein the coupled first barrel portion and second barrel portion are configured to have a reel-less bundle of cable mounted thereon between the first flange portion and the second flange portion;

wherein the first barrel portion, the first flange portion, and the first hub portion are portions of a first single piece structure of unitary construction;

wherein the second barrel portion, the second flange portion, and the second hub portion are portions of a second single piece structure of unitary construction;

wherein the inner wall and the outer wall of the first barrel portion and a wall of the first hub portion have a uniform thickness;

wherein the inner wall and the outer wall of the second barrel portion and a wall of the second hub portion have a uniform thickness;

wherein the inner wall and the outer wall of the first barrel portion are configured to move toward one another in the radial direction and/or the inner wall and the outer wall of the second barrel portion are configured to move toward one another when a force is applied to the reel in the radial direction;

wherein the inner wall of the first barrel portion includes a plurality of axially extending ribs that project radially inward from the inner wall of the first barrel portion;

wherein the outer wall of the second barrel portion includes a plurality of axially extending grooves configured to receive the plurality of axially extending ribs; and wherein the plurality of axially extending ribs and the plurality of axially extending grooves are configured to couple the first barrel portion and the second barrel portion to rotate together.

2. The reusable reel of claim 1, wherein the first hub portion and the second hub portion are configured to be aligned with one another in a first direction when the first barrel portion is coupled with the second barrel portion.

3. The reusable reel of claim 1, wherein the first reel member and the second reel member are configured to rotate together when a cable is being paid out from a reel-less bundle of cable mounted on the coupled first barrel portion and second barrel portion.

4. A reel comprising:

a first reel member including a first barrel portion, a first flange portion, and a first hub portion; and a second reel member including a second barrel portion, a second flange portion, and a second hub portion;

wherein the first barrel portion and the second barrel portion are configured to be coupled with one another;

wherein the first barrel portion includes an inner wall and an outer wall that are spaced apart from one another in a radial direction of the first barrel portion;

wherein the second barrel portion includes an inner wall and an outer wall that are spaced apart from one another in a radial direction of the second barrel portion;

wherein the first barrel portion, the first flange portion, and the first hub portion are portions of a first single piece structure of unitary construction;

wherein the second barrel portion, the second flange portion, and the second hub portion are portions of a second single piece structure of unitary construction; and wherein the outer wall of the second barrel portion includes a receiving portion structurally configured to have a circumferential dimension that increases from a first end at the second flange portion to a second end that is opposite the first end such that the second barrel portion includes a guide portion that is structurally configured to guide an alignment portion of the first barrel portion into the receiving portion when the first reel member is coupled with the second reel member.

5. The reel of claim 4, wherein the inner wall and the outer wall of the first barrel portion and a wall of the first hub portion have a uniform thickness; and wherein the inner wall and the outer wall of the second barrel portion and a wall of the second hub portion have a uniform thickness.

6. The reel of claim 4, wherein the first hub portion and the second hub portion are configured to be aligned with one another in a first direction when the first barrel portion is coupled with the second barrel portion.

7. The reel of claim 4, wherein the inner wall and the outer wall of the first barrel portion are configured to move toward one another and/or the inner wall and the outer wall of the second barrel portion are configured to move toward one another to absorb a force applied to the reel in the radial direction.

8. The reel of claim 4, wherein the first reel member and the second reel member are configured to rotate together when a cable is being paid out from a reel-less bundle of cable mounted on the coupled first barrel portion and second barrel portion.

9. The reel of claim 4, wherein the alignment portion includes a plurality of axially extending ribs that project radially inward from the inner wall of the first barrel portion;

wherein the receiving portion includes a plurality of axially extending grooves in the outer wall of the second barrel portion that are configured to receive the plurality of axially extending ribs; and wherein the plurality of axially extending ribs and the plurality of axially extending grooves are configured to couple the first barrel portion and the second barrel portion to rotate together.

10. The reel of claim 4, wherein the first and second barrel portions are configured to have a reel-less bundle of cable mounted thereon between the first flange portion and the second flange portion when coupled together.

11. A reel comprising:

a first reel member including a first barrel portion, a first flange portion, and a first hub portion; and a second reel member including a second barrel portion, a second flange portion, and a second hub portion;

wherein the first barrel portion and the second barrel portion are configured to be coupled with one another;

wherein the first barrel portion includes an inner wall and an outer wall that are spaced apart from one another in a radial direction of the first barrel portion;

wherein the first barrel portion, the first flange portion, and the first hub portion are portions of a first single piece structure of unitary construction; and wherein the second barrel portion includes a receiving portion structurally configured to have a circumferential dimension that increases from a first end at the second flange portion to a second end that is opposite the first end such that the second barrel portion includes a guide portion that is structurally configured to guide an alignment portion of the first barrel portion into the receiving portion when the first reel member is coupled with the second reel member.

12. The reel of claim 11, wherein the inner wall and the outer wall of the first barrel portion and a wall of the first hub portion have a uniform thickness.

13. The reel of claim 11, wherein the second barrel portion includes an inner wall and an outer wall that are spaced apart from one another in a radial direction of the second barrel portion.

14. The reel of claim 13, wherein the inner wall and the outer wall of the first barrel portion are configured to move toward one another and/or the inner wall and the outer wall of the second barrel portion are configured to move toward one another when a force is applied to the reel in the radial direction.

15. The reel of claim 13, wherein the inner wall and the outer wall of the second barrel portion and a wall of the second hub portion have a uniform thickness.

16. The reel of claim 11, wherein the first hub portion and the second hub portion are configured to be aligned with one another when the first barrel portion is coupled with the second barrel portion.

17. The reel of claim 11, wherein the inner wall and the outer wall of the first barrel portion are configured to move toward one another when a force is applied to the reel in the radial direction.

18. The reel of claim 11, wherein the first reel member and the second reel member are configured to rotate together when a cable is being paid out from a reel-less bundle of cable mounted on the coupled first barrel portion and second barrel portion.

19. The reel of claim 11, wherein the alignment portion includes a plurality of axially extending ribs that project radially inward from the inner wall of the first barrel portion;

wherein the receiving portion includes a plurality of axially extending grooves in an outer wall of the second barrel portion that are configured to receive the plurality of axially extending ribs; and wherein the plurality of axially extending ribs and the plurality of axially extending grooves are configured to couple the first barrel portion and the second barrel portion to rotate together.

* * * * *